US008259019B2

(12) United States Patent
Christ et al.

(10) Patent No.: US 8,259,019 B2
(45) Date of Patent: Sep. 4, 2012

(54) ANTENNA MOUNT ADAPTER

(75) Inventors: Barry Christ, Wyoming, NY (US); Donald B. Butterbaugh, Macedon, NY (US); Aaron K. Hendershot, Webster, NY (US)

(73) Assignee: Harris Corporation, Melbourne, FL (US)

( * ) Notice: Subject to any disclaimer, the term of this patent is extended or adjusted under 35 U.S.C. 154(b) by 1235 days.

(21) Appl. No.: 12/017,229

(22) Filed: Jan. 21, 2008

(65) Prior Publication Data

US 2012/0169551 A1 Jul. 5, 2012

(51) Int. Cl.
*H01Q 1/32* (2006.01)

(52) U.S. Cl. ..... 343/713; 343/715; 343/880

(58) Field of Classification Search ..... 343/713, 343/715, 745, 749, 752, 787, 828, 829, 830, 343/878, 880, 888, 900
See application file for complete search history.

(56) References Cited

U.S. PATENT DOCUMENTS

| | | | | | |
|---|---|---|---|---|---|
| 3,725,849 | A * | 4/1973 | Becke | 439/363 |
| 4,201,989 | A * | 5/1980 | Czerwinski | 343/715 |
| 4,302,760 | A * | 11/1981 | Laufer | 343/715 |
| 4,786,883 | A | 11/1988 | Spinner et al. | |
| 4,790,774 | A * | 12/1988 | White | 439/551 |
| 4,914,450 | A * | 4/1990 | Dilley et al. | 343/895 |
| 5,049,896 | A * | 9/1991 | Conley | 343/888 |
| 6,271,797 | B2 * | 8/2001 | Miller | 343/713 |
| 6,429,821 | B1 * | 8/2002 | Lewis, Jr. | 343/749 |
| 7,339,542 | B2 * | 3/2008 | Lalezari | 343/773 |

FOREIGN PATENT DOCUMENTS

| | | |
|---|---|---|
| WO | WO-0079642 | 12/2000 |

* cited by examiner

*Primary Examiner* — Michael C Wimer
(74) *Attorney, Agent, or Firm* — Fox Rothschild, LLP; Robert J. Sacco

(57) ABSTRACT

The invention concerns a rugged antenna mount adapter (100) for mounting an antenna (112) used by NATO vehicles to an existing antenna mount opening (113) of a non-NATO type armored vehicle, regardless of the thickness of the armor (110) on the vehicle. The antenna mount adapter has an upper member (116) and a lower member (118). The upper member (116) has two flanges (120, 122) separated by a hollow cylindrical body (116) having internal threads (134). The top flange (120) is adapted to receive a NATO style antenna and the bottom flange (122) is adapted to be attached to the outside surface and aligned with the antenna mount opening (113) of a non-NATO type armored vehicle. The lower member (118) is a hollow cylindrical body having a flange (140) at one end and a screw thread (136) which extends along the outside surface of the cylinder at the other end. The screw thread end of the lower member is designed to screw into the upper member from the interior of the vehicle until the flange on the lower member abuts the inside wall of the vehicle.

20 Claims, 4 Drawing Sheets

ANTENNA MOUNT ADAPTER

BACKGROUND OF THE INVENTION

1. Statement of the Technical Field

The inventive arrangement relates to antennas and more particularly to an antenna mount for use on a military vehicle.

2. Description of the Related Art

Radio communications between the crew of a military land vehicle with the crews of other military land vehicles, command headquarters, ground personal, and aircraft involved in a common mission is of critical importance during military operations. Also important is the ability of a military land vehicle to receive Global Positioning System information for navigational purposes.

An antenna for receiving and transmitting such information is preferably mounted external to a military vehicle and is typically mounted in a separate housing. For certain applications, and particularly for military ground vehicles, the antenna mount must be a sturdy mount which can withstand substantial forces on the antenna such as occurs when the antenna contacts trees or other structures.

Many military vehicles are armor plated and typically are provided with only one or two standard openings in their bodies for the placement of an antenna. As a result of political changes in various places throughout the world, military vehicles manufactured in different countries such as, for example Russia, China, and the former Soviet Union, are increasingly being used in a unified military force with vehicles operated by countries that are members of the North Atlantic Treaty Organization (hereinafter NATO). Consequently, a need exists for all vehicles in the exercise to have communication equipment which is compatible to NATO standards. Presently, military vehicles from some of these countries are not equipped with an antenna mount opening pattern which is compatible with or configured to accept an antenna used by NATO. In addition, armor plated vehicles which have an antenna mount opening which is not configured to meet NATO standards cannot be readily modified to accommodate an antenna mount which is designed to NATO specifications.

Known antenna mounts for military vehicles and the like, typically include a housing having an upper portion which extends beyond an outer wall of the vehicle and supports a flexible antenna, while a lower portion of the housing extends through the vehicle wall for connecting the antenna to radio apparatus. Such antenna mounts are attached only to the top of the armor plate of the vehicle with the existing bolts on the vehicle which hold the antenna mount to the vehicle. Also known from the prior art are mounting kits which use an additional mount at another location on the vehicle. Such mounts normally replace the existing antenna mounts and may change the profile of the antenna mount to a significant extent. Furthermore, such antenna mounts are not designed to withstand the forces that the antenna structure of armored military vehicles frequently experience.

It is desirable, therefore, to provide a rugged antenna mount for an armored vehicle which does not require modification to the exterior wall of the vehicle.

SUMMARY OF THE INVENTION

The invention concerns a rugged antenna mount adapter for mounting an antenna used by NATO vehicles to an existing antenna mount opening of an armored vehicle which does not conform to NATO antenna mount standards, regardless of the thickness of the armor on the vehicle.

The antenna mount adapter has an upper member and a lower member. The upper member has two flanges separated by a hollow cylindrical body having internal threads. The top flange is adapted to receive a NATO style antenna and the bottom flange is adapted to be attached to the outside surface and aligned with the antenna mount opening of a non-NATO type armored vehicle. The lower member is a hollow cylindrical body having a flange at one end and a screw thread which extends along the outside surface of the cylinder at the other end. The screw thread end of the lower member is designed to screw into the upper member from the interior of the vehicle until the flange on the lower member abuts the inside wall of the vehicle.

Advantageously, clearance openings in the bottom flange of the upper member are aligned with threaded openings provided around the perimeter of the antenna mount opening of the non-NATO type armored vehicle, and the upper member is secured to the vehicle with bolts which are inserted into the threaded openings. In the case of armored vehicles conforming to the mounting system used in the former Soviet Union, the six evenly spaced clearance openings are provided in the bottom flange of the upper member. These six clearance openings are aligned with six threaded openings provided around the perimeter of the antenna mount opening. A gasket can be placed between the flange and the vehicle to provide a water tight seal. Thereafter, and from the inside of the vehicle, the threaded end of the lower member is threaded into the upper member until the flange on the lower member makes good contact with the inside wall of the armor of the non-NATO type armored vehicle. At this time, a NATO type antenna can be attached to the top flange of the upper member with bolts which pass through clearance openings in the antenna mounting base and thread into threaded openings in the flange. According to one aspect of the invention, there are four evenly spaced clearance openings provided in the antenna mounting base that can be aligned with four threaded openings in the flange. A gasket located between the antenna mounting base and the flange will provide a water tight seal and the coaxial cable from the antenna is positioned to pass through the hollow cylinders and into the interior of the vehicle. It is understood that the upper member may be attached to the vehicle either before or after the antenna mounting base is attached to the upper member.

DETAILED DESCRIPTION OF THE PREFERRED EMBODIMENTS

The invention concerns a rugged antenna mount adapter for mounting a first type of antenna mounting base to an existing antenna mount opening designed for a second type mounting base, different from the first type mounting base. The invention is particularly well suited for mounting an antenna having a standard NATO type antenna mounting base to an armored vehicle which does not conform to NATO antenna mount standards, regardless of the thickness of the armor on the vehicle. Examples of armored vehicles that do not conform to NATO antenna mount standards are those which have been produced for China, Russia, and the former Soviet Union. For convenience, such armored vehicles shall be referred to herein as non-NATO type armored vehicles. Also, the invention shall be described herein with reference to a style of antenna mount used by Russia and the former Soviet Union. However, it should be understood that the invention is not limited in this regard. The invention can also be used with non-NATO type armored vehicles having other types of antenna mounts without limitation.

Figure 1:
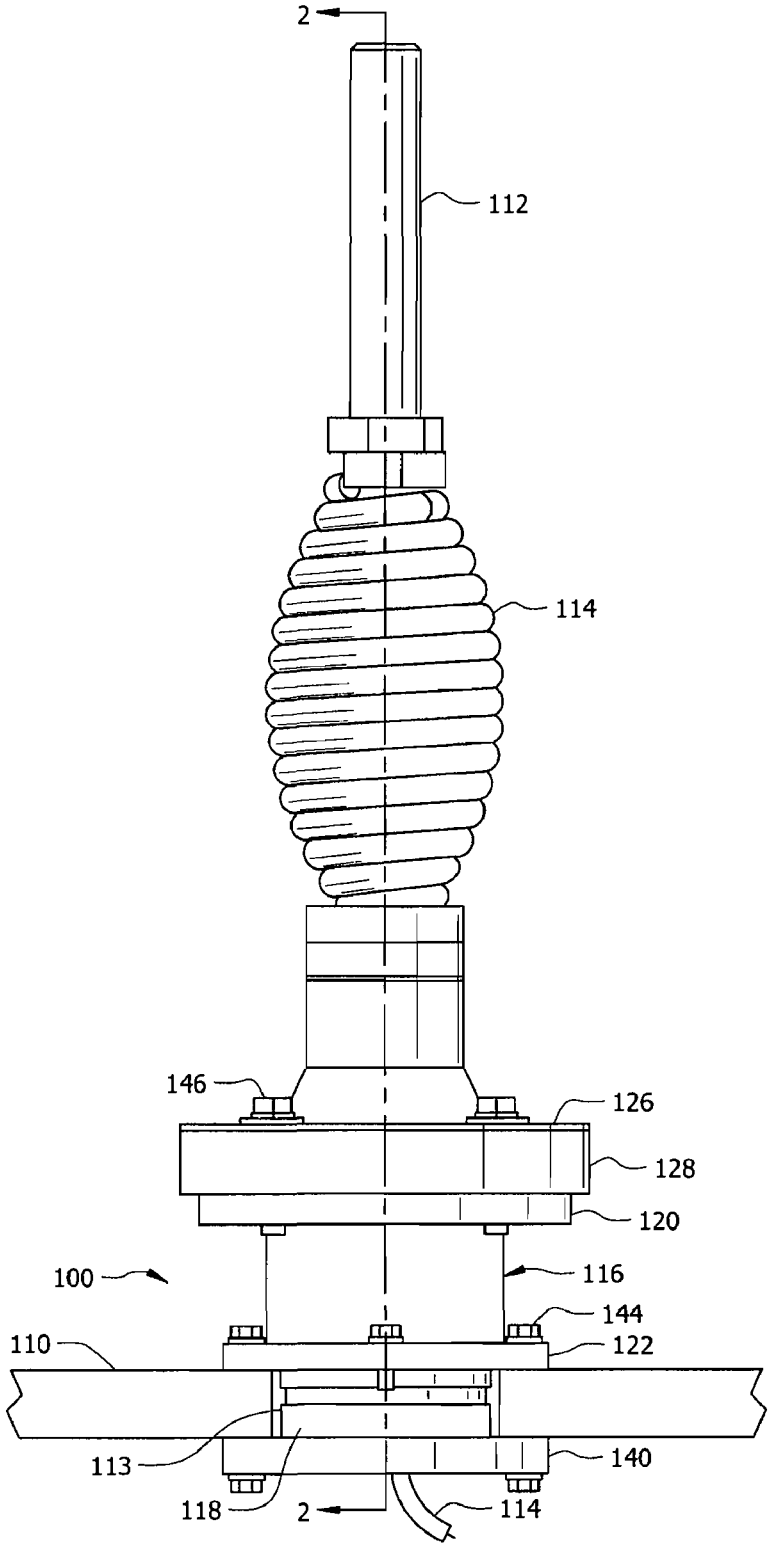
FIG. 1 is a schematic representation of an antenna mount adapter incorporating the principles of the invention.
Figure 2:
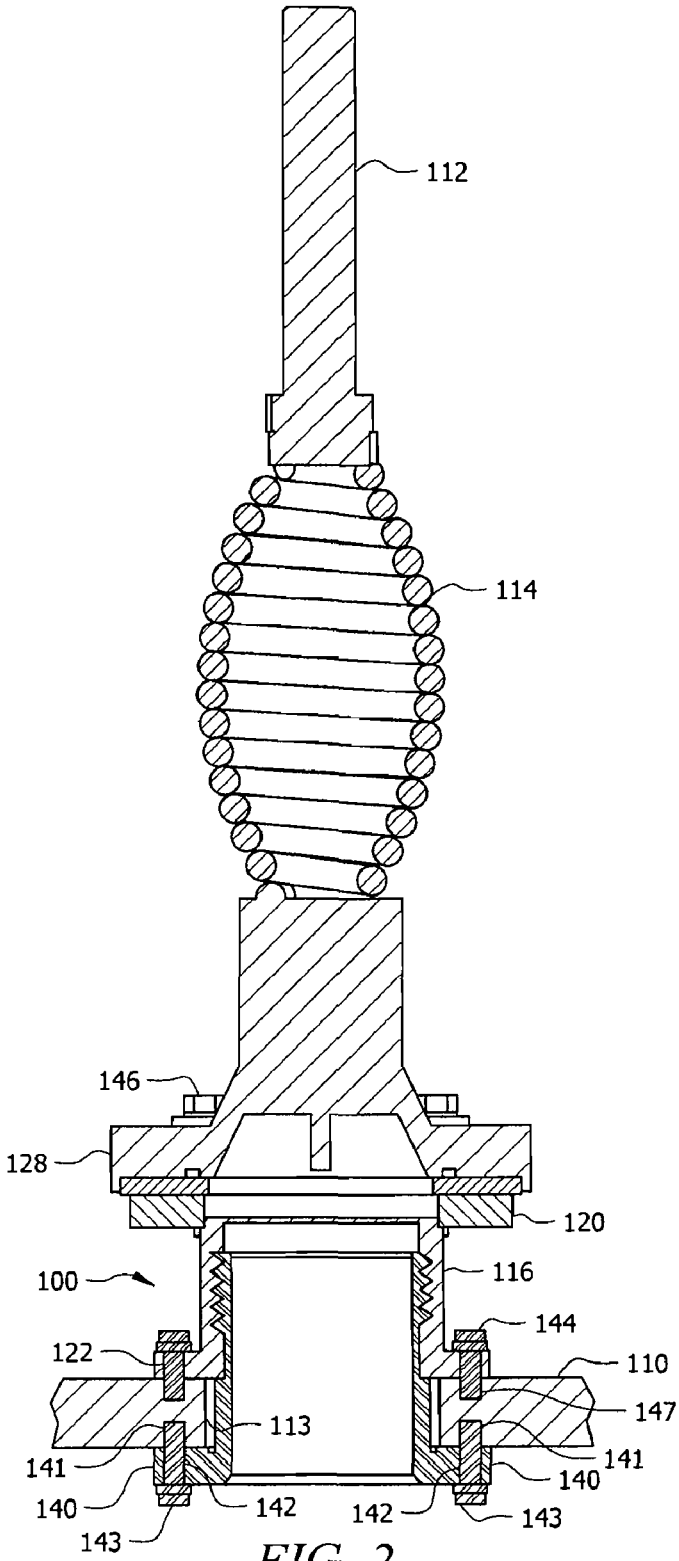
FIG. 2 is a cross sectional view along line 2-2 of FIG. 1.

Referring to FIGS. 1 and 2 there is disclosed an antenna mounting adapter 100 connected to the armor wall 110 of a vehicle. The antenna mounting adapter 100 supports a radio frequency antenna 112 attached to a coiled spring 114 as is commonly used on a military vehicle. The antenna and its associated electronics are adapted for communication with other military personnel and possibly for receiving global positioning system signals. The antenna 112 is provided with an antenna mounting base 128 which conforms to a first type of antenna mounting base configuration. For example, the first type antenna mounting base configuration can be a standard antenna mount configuration used by NATO. In contrast, the armor wall 110 has one or more openings 113 defined therein which conform to a second type antenna mounting base configuration for receiving a second type mounting base (not shown) which is different from the first type mounting base 128. For example, the second type mounting base configuration can be a mounting base configuration used by the former Soviet Union. Also shown in FIG. 1 is a radio frequency connection cable 114, which extends through upper member 116, and lower member 118. The upper member 116 and lower member 118 are advantageously formed as hollow cylinders for allowing the cable 114 from the antenna 112 to extend into the vehicle and connect to radio frequency equipment (not shown) located in the interior of the vehicle.

Figure 3:
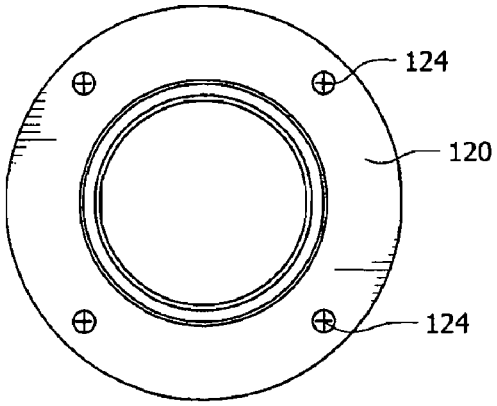
FIG. 3 is a top view of the upper member
Figure 4:
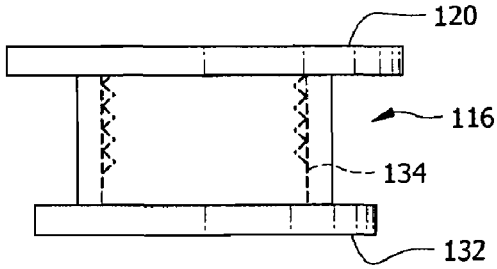
FIG. 4 is a side view of the upper member.
Figure 5:
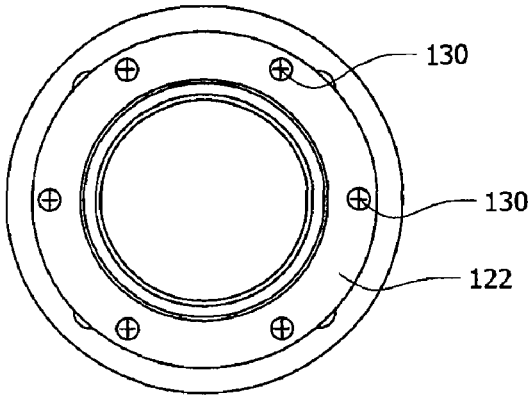
FIG. 5 is a bottom end view of the upper member.

Referring to FIGS. 3-5, there is shown the upper member 116 which is advantageously formed as a hollow cylindrical structure. Upper member 116 has a top flange 120 located at the top of the cylindrical structure and a bottom flange 122 located at the bottom of the cylindrical structure. If the first type antenna mounting base configuration is a standard NATO antenna mount configuration, then the top flange can in one embodiment have four threaded openings 124 which are evenly spaced around the flange and located on a common center. However, it should be understood that the invention described herein is not limited in this regard. For example, the top flange can alternatively have threaded openings 124 which conform with other types of antenna mounting base configurations. The threaded openings 124 in the top flange 120 are located to be in alignment with clearance openings 126 in the antenna mounting base 128. The bottom flange 122 at the bottom of the upper member 116 has clearance openings 130 designed to conform to the second type antenna mounting base configuration on an armored vehicle. For example, in order to conform to armored vehicles manufactured by the former Soviet Union, the six clearance openings 130 can be evenly spaced around the flange and located on a common center. The clearance openings 130 are located to be aligned with threaded openings 147 located in the armor wall 110 around the antenna mount opening 113.

Figure 6:
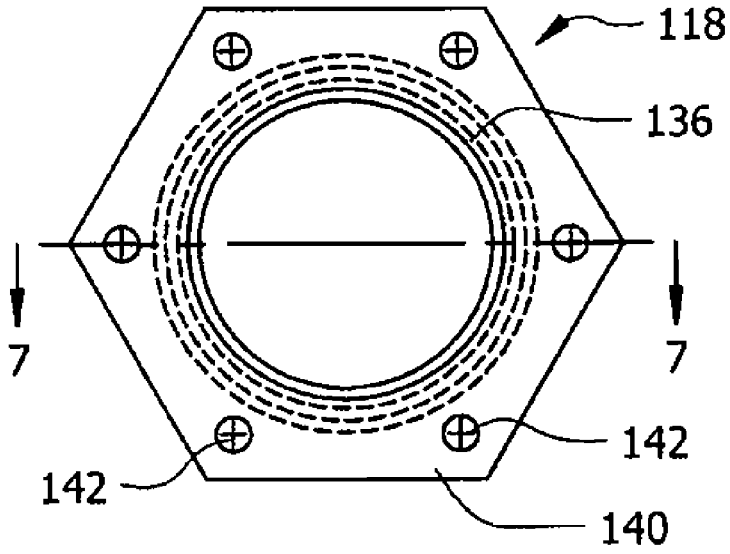
FIG. 6 is a bottom end view of the lower member.
Figure 7:
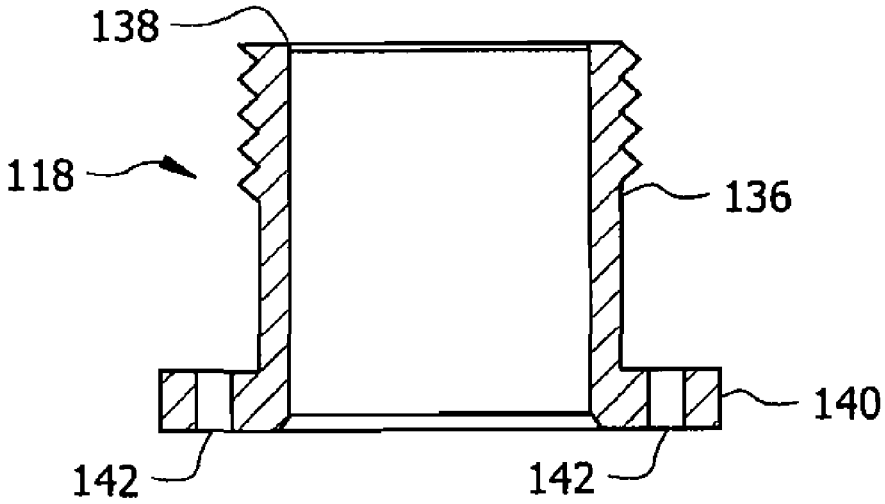
FIG. 7 is a cross sectional view of the lower member along line 7-7 if FIG. 6.

Upper member 116 supports a screw thread 134 on the inside wall which extends up from the bottom end 132 of the upper member 116. According to one embodiment, the screw thread 134 can extend for a distance which is less than the entire length of the cylindrical structure defined by upper member 116. However, the invention is not limited in this regard. The lower member 118, see FIGS. 6 and 7, can be a hollow cylinder having a screw thread 136 at one end and a flange 140 at the other end. The screw thread 136 on the outside of the cylinder is configured to thread into the threads 134 on the inside surface of the upper member 116. The threads extend down from the top end 138 of the lower member 118. According to an embodiment of the invention, the screw threads extend for a distance which is less than the length of the cylinder. However, the invention is not limited in this regard. Flange 140 supports openings 142 which are spaced around the circumference defined by the flange in accordance with the second antenna base mounting configuration. According to an embodiment of the invention, six of the openings 142 are provided evenly spaced around the flange and located on a common center as shown to conform to an antenna mount style used by certain countries, such as the former Soviet Union. The openings 142 may be threaded or left as clearance openings.

Referring to FIG. 2, there is shown a cross sectional view along the line 2-2 of FIG. 1 where the antenna mount opening adapter is attached to the surface armor of a non-NATO type armored vehicle and coupled to an antenna used by NATO. Still it should be understood that the invention can also be used with other non-conforming antenna mount configurations.

Initially, to attach the antenna mounting adapter to an armored vehicle having the second type of antenna base mounting configuration, the bottom flange 122 at the bottom of the upper member 116 is placed over the antenna mount opening on the outside of the armored vehicle and oriented to align the clearance openings 130 in the flange with the threaded openings in the vehicle. To provide a water resistant seal, a gasket can be placed between the flange 122 and the vehicle. Fasteners such as bolts 144 having threads which mate with the screw threads in the threaded openings in the vehicle are inserted through the clearance openings 130, into the threaded openings and tightened to hold the upper member 116 securely to the outside surface of the body of the vehicle. A gasket of cork, rubber or other material (not shown) can be placed between the armor wall 110 and the flange 122 to provide a water tight seal. At this time, the antenna mounting base 128 can be placed on top of the top flange 120 of the upper member and positioned to align the clearance openings in the antenna base with the threaded openings 124 in the flange 120. A gasket of cork, rubber other material can be placed between the antenna base and the flange 120 to provide a water tight seal. Fasteners such as bolts 146 are then inserted through clearance openings in the antenna mounting base 128 and screwed into the threaded openings 124 in flange 120 to securely couple the antenna mounting base 128 to the flange 120. As the antenna mounting base 128 is placed on top of the flange 120, the wires or coaxial cable from the antenna can be fed through the upper member to the interior of the vehicle.

At this time, and from the interior of the vehicle, the installer passes the wire from the antenna through the opening in the lower member and inserts the threaded end 138 of the lower member into the antenna mount opening in the vehicle and screws the lower member into the upper member until the flange 140 of the lower member presses against the inside surface of the vehicle armor. A gasket (not shown) placed between the flange 140 of the lower member 118 and the inside surface of the armor wall 110 can be used to provide a water tight seal.

With the embodiment disclosed, the antenna mount adapter 100 can be used on any non-NATO type armored vehicle regardless of the thickness of the armor. In this regard it should be noted that the threads 134, 136 will allow a clearance space between flange 140 and flange 122 to be adjusted as necessary to accommodate armored walls 110 having a variety of different thicknesses. In addition, the antenna mount adapter 100 can be easily installed in the field with hand tools and, when installed, mechanical loads on the antenna mounting base 128 are transferred to the armor wall 110 to provide an antenna mount which is rugged and resistant to impacts.

The openings 142 which are spaced around the circumference in the flange 140 are provided for mounting screws. As noted above, the threaded end 138 of the lower member 118 is threaded into the upper member 116 until the flange 140 of the lower member presses against the inside surface of the vehicle armor. According to an embodiment of the invention, the flange 140 is advantageously tightened until the openings 142 align with corresponding openings or bores formed in the armor. Openings 141 can be threaded for receiving screws 143. In one embodiment of the invention (not shown) the openings 141 can be aligned with the threaded openings 147 to form through holes in the armor. With the foregoing arrangement, the lower member 118 will be secured not only by means of the threaded engagement with the upper member 116 but also by screwing the flange 140 to the turret opening. This increases strength by spreading any impact load to the armor plate.

While there has been described herein the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

What is claimed is:

1. An antenna mount adapter for coupling an antenna having a first type mounting base configuration to an existing antenna mount opening in an armored vehicle having a second type mounting base configuration, the antenna mount adapter comprising:

an upper member having a top surface configured to support a mounting base of a radio frequency antenna and a bottom surface configured to mount on an outer wall of the armored vehicle;

a first centrally located opening extending through said upper member from said top surface to said bottom surface for receiving a conductor from said antenna;

a lower member having a first end sized and shaped for insertion into said first centrally located opening in the upper member and a second end having a flange configured to engage an inner wall of the armored vehicle when said first end is inserted into said first centrally located opening in the upper member;

a second centrally located opening extending through said lower member from said first end to said second end;

a first plurality of spaced openings in said top surface located around said first centrally located opening in said upper member configured to receive fasteners for coupling said mounting base of said radio frequency antenna to said upper member, said first plurality of spaced openings having an arrangement corresponding to a pattern of said first type mounting base configuration;

a second plurality of spaced openings in said bottom surface located around said first centrally located opening in said upper member configured to receive fasteners for coupling said upper member to the outer wall of the vehicle; and a third plurality of spaced openings in said flange located around said second centrally located opening configured to receive fasteners for coupling said flange to said inner wall of said armored vehicle;

wherein said second and third plurality of spaced openings have a configuration corresponding to a pattern of said second type mounting base configuration, and wherein an adjustable clearance space is provided between said flange and said bottom surface to accommodate therein armor of various thickness, whereby said antenna having said first type mounting base configuration can be mounted on vehicles having said second type mounting base configuration and having armor of variable thickness.

2. The antenna mount adapter of claim 1 wherein said first plurality of spaced openings are evenly spaced around a first common center defined by said centrally located opening in said upper member.

3. The antenna mount adapter of claim 2 wherein said first plurality of spaced openings are threaded openings.

4. The antenna mount adapter of claim 2 wherein said first plurality of spaced openings comprise at least four openings.

5. The antenna mount adapter of claim 2 wherein said second plurality of evenly spaced clearance openings comprise at least six openings.

6. The antenna mount adapter of claim 1 wherein said first plurality of spaced openings comprise at least four openings; and said second plurality of spaced openings comprise at least six openings.

7. The antenna mount adapter according to claim 1, wherein said upper member comprises a first threaded portion formed on said first centrally located opening extending through said upper member, and said lower member comprises a second threaded portion formed on said first end of said lower member;

wherein said first threaded portion and said second threaded portion are configured to engage each other to thereby secure said upper member to said lower member.

8. The antenna mount adapter according to claim 1, wherein a distance between said flange provided on said lower member for engaging said inner wall, and said bottom surface of said upper member is selectively adjustable to accommodate a wall thickness of said armored vehicle.

9. The antenna mount adapter according to claim 1, wherein said top surface and said first plurality of spaced openings in said top surface conform to a standard NATO type antenna mounting base configuration.

10. The antenna mount adapter according to claim 9, wherein said bottom surface, said second plurality of spaced openings in said bottom surface, and said third plurality of spaced openings in said flange conform to a non-NATO type antenna mounting base configuration.

11. An antenna mount adapter for coupling an antenna having a first type mounting base configuration to an existing antenna mount opening in an armored vehicle having a second type mounting base configuration, the antenna mount adapter comprising:

an upper member having a top flange configured to mate with a mounting base of a radio frequency antenna having said first type mounting base configuration, and a bottom flange configured to engage the outer wall of the vehicle which has been preconfigured to mate with a mounting base of a radio frequency antenna having said second type mounting base configuration different from said first type mounting base configuration;

a first centrally located opening extending through said upper member from said top flange to said bottom flange for receiving a conductor from said antenna;

a lower member having a first end sized and shaped for insertion into the first centrally located opening in the upper member and a second end having an inner flange configured to engage an inner wall of the vehicle when said first end is inserted into said first centrally located opening in the upper member;

a first plurality of evenly spaced openings located on a first common center around said first centrally located opening in said top flange configured to receive fasteners for coupling said radio frequency antenna to said top flange, said first plurality of evenly spaced openings having an arrangement corresponding to a pattern of said first type mounting base configuration;

a second plurality of evenly spaced openings located on a second common center around said first centrally located opening in said bottom flange configured to receive fasteners for coupling said bottom flange to the outer wall of the vehicle, said second plurality of evenly spaced openings having an arrangement corresponding to a pattern of said second type mounting base configuration; and wherein an adjustable clearance space is provided between said bottom flange and said inner flange whereby said adapter is configured to be mounted on vehicles having armor of varying thicknesses.

12. The antenna mount adapter of claim 11 wherein:

said first plurality of evenly spaced openings in said top flange comprises at least four threaded openings; and said second plurality of evenly spaced openings in said bottom flange comprises at least six openings.

13. The antenna mount adapter according to claim 11, wherein said upper member comprises a first threaded portion formed on said centrally located opening extending through said upper member, wherein said lower member comprises a second threaded portion formed on said first end and;

wherein said first threaded portion and said second threaded portion are configured to engage each other to thereby secure said upper member to said lower member.

14. The antenna mount adapter according to claim 13, wherein a distance between said inner flange provided on said lower member for engaging said inner wall, and said bottom flange of said upper member is selectively adjustable to accommodate a wall thickness of said armored vehicle.

15. The antenna mount adapter according to claim 11, wherein said first plurality of evenly spaced openings in said top flange conforms to a standard NATO type antenna base mounting configuration.

16. The antenna mount adapter according to claim 15, wherein said second plurality of evenly spaced openings in said bottom flange conform to a non-NATO standard type antenna base mounting configuration.

17. An antenna mount adapter for coupling an antenna to an existing antenna mount opening in a non-NATO type armored vehicle, the antenna mount adapter comprising:

an upper member having a top surface configured to support a radio frequency antenna and a bottom surface configured to mount on an outer wall of the vehicle;

a centrally located opening extending through said upper member from said top surface to said bottom surface, said centrally located opening having a screw thread which extends up from the bottom surface of the centrally located opening of the upper member for a distance which is less than the entire length of the upper member;

a first plurality of evenly spaced openings in said top surface located on a first common center around said centrally located opening in said upper member for receiving fasteners for coupling said radio frequency antenna to said upper member;

a second plurality of evenly spaced openings in said bottom surface located on a second common center around said centrally located opening in said upper member for receiving fasteners for coupling said upper member to the outer wall of the vehicle;

a lower member having a first end and a second end, said first end having a screw thread for engaging the screw thread in the centrally located opening in the upper member and the second end having a flange configured to engage an inner wall of the vehicle when said first end is threaded into said centrally located opening in the upper member;

a second centrally located opening extending through said lower member from said first end to said second end; and a third plurality of evenly spaced openings in said flange located around said second centrally located opening arranged to receive fasteners for coupling said flange to said inner wall of said armored vehicle;

wherein an adjustable clearance space is provided between said bottom surface and said flange whereby said antenna mount adapter is configured to be mounted on vehicles having armor of variable thickness.

18. The antenna mount of claim 17 wherein the thickness of the armor of the vehicle determines the spacing between the flange on the lower member and the bottom surface of the upper member.

19. A method of coupling an antenna mount adapter to an existing antenna mount opening in a non-NATO type armored vehicle comprising the steps of:

placing an upper member having a first centrally located threaded opening, a top flange for supporting a radio frequency antenna and a bottom flange for mounting to an outer wall of the vehicle onto an antenna mount opening in the vehicle;

aligning openings in the bottom flange of the upper member with threaded openings located around the antenna mount opening on the outside of the vehicle;

securing the upper member to the outside of the vehicle by placing threaded fasteners into the openings in the bottom flange and threading them into the threaded openings in the armor of the vehicle;

placing a first threaded end of a lower member having a first threaded end, a second flanged end, and a second centrally located opening into the antenna mount opening from the inside of the vehicle;

threading the lower member into the upper member a distance which is less than an entire length of the upper member until the flange on the lower member abuts the inside surface of the armored vehicle, thereby adjusting a spacing between the flange on the lower member and the bottom flange to accommodate the armor of the vehicle; and inserting an antenna feed cable through said first and second centrally located openings.

20. The method of claim 19 further comprising the step of attaching an antenna to the top flange of the upper member.

* * * * *